US010377601B2

(12) United States Patent
Tanaka et al.

(10) Patent No.: US 10,377,601 B2
(45) Date of Patent: Aug. 13, 2019

(54) SHEET STACKING TRAY AND IMAGE FORMING APPARATUS PROVIDED WITH SAME

(71) Applicant: KYOCERA Document Solutions Inc., Osaka (JP)

(72) Inventors: Hiroyuki Tanaka, Osaka (JP); Motoyuki Fukuda, Osaka (JP); Tetsuya Ichiguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 211 days.

(21) Appl. No.: 15/301,843

(22) PCT Filed: Oct. 27, 2015

(86) PCT No.: PCT/JP2015/080214

§ 371 (c)(1),
(2) Date: Oct. 4, 2016

(87) PCT Pub. No.: WO2016/111073

PCT Pub. Date: Jul. 14, 2016

(65) Prior Publication Data

US 2017/0174464 A1 Jun. 22, 2017

(30) Foreign Application Priority Data

Jan. 7, 2015 (JP) ..... 2015-001320

(51) Int. Cl.
*B65H 31/20* (2006.01)
*G03G 15/00* (2006.01)
*B65H 31/02* (2006.01)

(52) U.S. Cl.
CPC ..... *B65H 31/20* (2013.01); *B65H 31/02* (2013.01); *G03G 15/00* (2013.01);
(Continued)

(58) Field of Classification Search
CPC ..... B65H 31/20; B65H 2405/10; B65H 2405/1117; B65H 2405/1172;
(Continued)

(56) References Cited

U.S. PATENT DOCUMENTS 6,053,493 A * 4/2000 Yokoyama ..... B65H 1/266 211/126.7
8,087,658 B2 * 1/2012 Ohtsuki ..... B65H 5/26 271/162

(Continued)

FOREIGN PATENT DOCUMENTS

JP S 56-3149 1/1981
JP 56-13450 U1 2/1981

(Continued)

OTHER PUBLICATIONS

Extended European Search Report dated Jul. 3, 2018, issued by the European Patent Office in corresponding application EP 15876946.3.

(Continued)

*Primary Examiner* — Thomas A Morrison
(74) *Attorney, Agent, or Firm* — Stein IP, LLC

(57) ABSTRACT

Provided is a sheet stacking tray such that damage due to external force can be suppressed. The sheet stacking tray (30) is provided with a tray body (40), a first slide member (50), and a second slide member (60). When the first slide member and the second slide member are pulled out, the engagement between a first storage catch portion (44) of the tray body and a first latch portion (52) of the first slide member is released, and then the engagement between a second storage catch portion (54) of the first slide member and a second latch portion (62) of the second slide member is released.

6 Claims, 12 Drawing Sheets

(52) U.S. Cl.
CPC ... *G03G 15/6552* (2013.01); *B65H 2402/343* (2013.01); *B65H 2404/691* (2013.01); *B65H 2405/11164* (2013.01); *B65H 2405/324* (2013.01); *B65H 2801/06* (2013.01); *G03G 2215/00421* (2013.01)

(58) Field of Classification Search
CPC .. B65H 2405/1122; B65H 31/00; B65H 1/04; B65H 1/027; B65H 1/266; B65H 2402/32; B65H 2405/36; B65H 2405/361; B65H 2701/11
See application file for complete search history.

(56) References Cited

U.S. PATENT DOCUMENTS

| | | | | |
|---|---|---|---|---|
| 2008/0124121 | A1 | 5/2008 | Seike et al. | 399/124 |
| 2015/0042035 | A1* | 2/2015 | Washino | B65H 1/04 271/145 |

FOREIGN PATENT DOCUMENTS

| | | | |
|---|---|---|---|
| JP | 2011-235986 | A | 11/2011 |
| JP | 2013-18581 | A | 1/2013 |

OTHER PUBLICATIONS

European Office Action dated Dec. 3, 2018, from the European Patent Office in corresponding application EP 15 876 946.3.

* cited by examiner

EASE IN SLIDING OVER : X1→X3
X2→X3

EASE IN SLIDING OVER : Y1→Y3
Y2→Y3

SHEET STACKING TRAY AND IMAGE FORMING APPARATUS PROVIDED WITH SAME

CROSS-REFERENCE TO RELATED APPLICATIONS

This application is a national stage of International Application No. PCT/JP2015/080214, filed Oct. 27, 2015, which claims the benefit of priority to Japanese Application No. 2015-001320, filed Jan. 7, 2015, in the Japanese Patent Office, the disclosures of which are incorporated herein in their entireties by reference.

TECHNICAL FIELD

The present invention relates to a sheet placement tray (sheet stacking tray) configured as a pullout type such that its sheet placement surface on which sheets are placed is extendable, and to an image forming apparatus provided with such a sheet placement tray.

BACKGROUND ART

Generally, in image forming apparatuses such as copiers, printers, and facsimile machines, there are widely used sheet feed trays and discharge trays on which sheet-form recording media are placed. It is preferable that sheet feed trays and discharge trays be small when not in use but be large enough to fit the size of sheets when in use. Thus, trays are known that are configured as a pullout type such that their sheet placement surface can be extended.

For example, in Patent Document 1, there is disclosed a medium supporting tray that includes a base portion, a first pullout portion which is slidable with respect to the base portion, and a second pullout portion which is slidable with respect to the first pullout portion. In the medium supporting tray, a flat spring that is engaged with the first pullout portion is arranged in the base portion, and a flat spring that is engaged with the second pullout portion is arranged in the first pullout portion. Setting the spring force of the flat spring arranged in the base portion weaker than the spring force of the flat spring arranged in the first pullout portion allows the first pullout portion to be pulled out first when the first and second pullout portions are pulled out from a state where they are stored, and thus the second pullout portion, which is the weakest in strength due to its dimensions, can be prevented from being pulled out alone.

LIST OF CITATIONS

Patent Literature

Patent Document 1: JP-A-2013-18581

SUMMARY OF THE INVENTION

Technical Problem

However, according to the above-described medium supporting tray of Patent Document 1, when the first and second pullout portions are stored from a state where they are pulled out, the first pullout portion is stored in the base portion before the second pullout portion is stored in the first pullout portion. Thus, the second pullout portion, which is the weakest in strength due to its dimensions, occasionally remains pulled out alone; this inconveniently makes the medium supporting tray likely to be damaged by an external force.

Devised against the background discussed above, an object of the present invention is to provide a sheet placement tray that can be prevented from being damaged by an external force, and to provide an image forming apparatus provided with such a sheet placement tray.

Means for Solving the Problem

According to one aspect of the present invention, a sheet placement tray (sheet stacking tray) includes a tray main body which has a sheet placement surface on which sheets are placed, a first slide member which is slidable with respect to the tray main body and which is arranged selectively either in a first stored position where it is stored in the tray main body or in a first pulled-out position where it is pulled out of the tray main body so as to extend the sheet placement surface, and a second slide member which is slidable with respect to the first slide member and which is arranged selectively either in a second stored position where it is stored in the first slide member or in a second pulled-out position where it is pulled out of the first slide member so as to extend the sheet placement surface. The tray main body includes a first storage engaged portion which is engaged with a first engaging portion of the first slide member in a state where the first slide member is stored in the first stored position, and a first pullout engaged portion which is engaged with the first engaging portion in a state where the first slide member is pulled out in the first pulled-out position. The first slide member includes the first engaging portion, a second storage engaged portion which is engaged with a second engaging portion of the second slide member in a state where the second slide member is stored in the second stored position, and a second pullout engaged portion which is engaged with the second engaging portion in a state where the second slide member is pulled out in the second pulled-out position. The second slide member includes the second engaging portion. When the first and second slide members are pulled out from a state where they are stored respectively in the first and second stored positions, the engagement of the first storage engaged portion with the first engaging portion is released, and thereafter the engagement of the second storage engaged portion with the second engaging portion is released. When the first and second slide members are stored from a state where they are pulled out respectively in the first and second pulled-out positions, the engagement of the second pullout engaged portion with the second engaging portion is released, and thereafter the engagement of the first pullout engaged portion with the first engaging portion is released.

Advantageous Effects of the Invention

According to the sheet placement tray of the present invention, when the first and second slide members are pulled out from a state where they are stored respectively in the first and second stored positions, the engagement of the first storage engaged portion of the tray main body with the first engaging portion of the first slide member is released, and thereafter the engagement of the second storage engaged portion of the first slide member with the second engaging portion of the second slide member is released. In this way, when the first and second slide members are pulled out, the first slide member is pulled out first, and thus the second slide member, which is weak in strength due to its dimensions, can be prevented from being pulled out alone.

When the first and second slide members are stored from a state where they are pulled out respectively in the first and second pulled-out positions, the engagement of the second pullout engaged portion of the first slide member with the second engaging portion of the second slide member is released, and thereafter the engagement of the first pullout engaged portion of the tray main body with the first engaging portion of the first slide member is released. In this way, when the first and second slide members are stored, the second slide member is stored first, and thus the second slide member, which is weak in strength due to its dimensions, can be prevented from being pulled out alone.

Thus, both when the first and second slide members are pulled out and when they are stored, the second slide member, which is weak in strength due to its dimensions, can be prevented from being pulled out alone, and thereby the sheet placement tray can be prevented from being damaged by an external force.

Further features and advantages of the present invention will become apparent from the description of embodiments given below.

DESCRIPTION OF EMBODIMENTS

Hereinafter, embodiments of the present invention will be described with reference to the accompanying drawings.

First Embodiment

Figure 1:
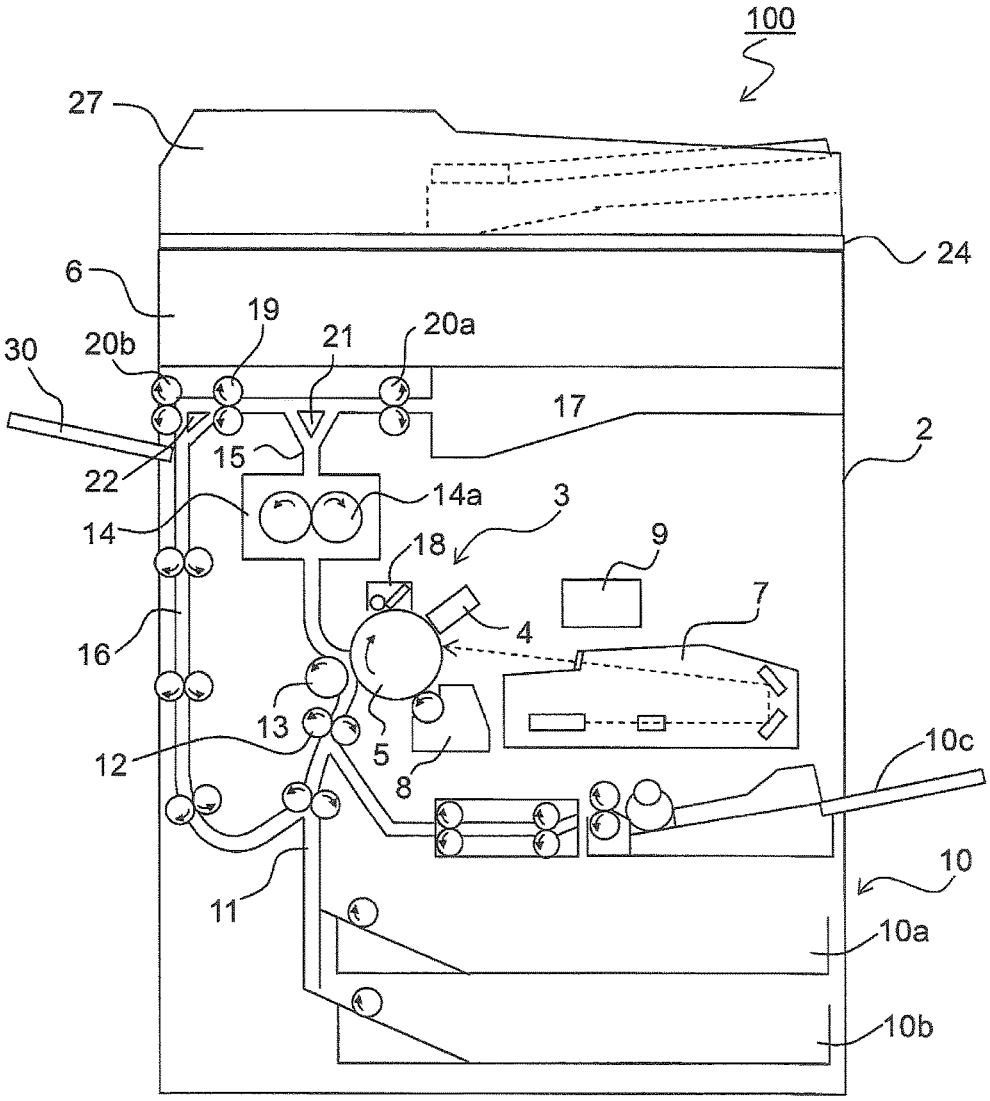
[FIG. 1] is a sectional view showing a structure of an image forming apparatus provided with a second discharge tray (sheet placement tray) according to a first embodiment of the present invention.

With reference to FIGS. 1 to 19, a description will be given of the structure of an image forming apparatus 100 that is provided with a second discharge tray (sheet placement tray) 30 according to a first embodiment of the present invention. In the image forming apparatus 100 shown in FIG. 1 (here a digital multifunction peripheral is taken as an example), a copy operation proceeds as follows. In an image reading device 6, document image data is read and converted into an image signal. On the other hand, in an image forming portion 3 inside a multifunction peripheral main body 2, a photosensitive drum 5 that rotates in the clockwise direction in FIG. 1 is electrostatically charged uniformly by a charging unit 4, and an electrostatic latent image is formed on the photosensitive drum 5 by a laser beam from an exposure unit (such as a laser scanner unit) 7 based on the document image data read in the image reading device 6. Then, developer (hereinafter referred to as toner) is attached to the electrostatic latent image by a developing unit 8, and thereby a toner image is formed. Toner is fed to the developing unit 8 from a toner container 9.

Toward the photosensitive drum 5 having the toner image formed on it as described above, a sheet (recording medium) is transported from a sheet feeding mechanism 10 via a sheet transport passage 11 and a registration roller pair 12 to the image forming portion 3. In the image forming portion 3, the toner image on the surface of the photosensitive drum 5 is transferred to the sheet by a transfer roller 13 (image transfer portion). Then, the sheet to which the toner image has been transferred is separated from the photosensitive drum 5, and is transported to a fixing portion 14, where the toner image is fixed. The fixing portion 14 has a fixing roller pair 14*a*. The sheet which has passed through the fixing portion 14 is transported to a sheet transport passage 15 which branches into a plurality of directions, and the sheet is distributed among different transport directions by passage switching mechanisms 21 and 22 which has a plurality of passage switching guides arranged at branch points in the sheet transport passage 15. The sheet is then, as it is (or after being transported to a sheet transport passage 16 and being subjected to two-sided copying), discharged via a discharge roller pair 20*a* or a discharge roller pair 20*b* onto a sheet discharge portion including a first discharge tray 17 and the second discharge tray (sheet placement tray) 30.

Moreover, although no illustration is given, a destaticizer that removes electrostatic charge remaining on the surface of the photosensitive drum 5 is arranged on the downstream side of a cleaning device 18. Furthermore, the sheet feeding mechanism 10 is removably fitted to the multifunction peripheral main body 2. The sheet feeding mechanism 10 includes a plurality of sheet feed cassettes 10*a* and 10*b* for storing sheets and a stack bypass (manual tray) 10*c* arranged over the sheet feed cassettes 10*a* and 10*b*; these are connected, via the sheet transport passage 11, to the image forming portion 3 that includes the photosensitive drum 5, the developing unit 8, etc.

In an upper part of the multifunction peripheral main body 2, the image reading device 6 is arranged. Over the top surface of the multifunction peripheral main body 2, a platen (document presser) 24 is openably/closably arranged that presses and thereby holds a document placed on a contact glass (unillustrated) in the image reading device 6. On the platen 24, a document transport device 27 is provided that automatically transports a document to the image reading device 6.

The sheet transport passage 15 is configured specifically as follows. The sheet transport passage 15 first branches into left and right passages on the downstream side of the fixing roller pair 14*a*. Of these passages, one (the passage that branches in the rightward direction in FIG. 1) communicates with the first discharge tray 17, and the other (the passage that branches in the leftward direction in FIG. 1) then further branches into upper and lower passages via a transport roller pair 19. Of these passages, one (the passage that branches in the leftward direction in FIG. 1) communicates with the second discharge tray 30 while the other (the passage that branches in the down direction in FIG. 1) communicates with the sheet transport passage 16.

The second discharge tray 30 is pivotably supported on a side surface of the main body of the image forming apparatus 100. The second discharge tray 30 is arranged selectively either in an open position (the position in FIG. 1) where it is open by a predetermined angle from the side surface of the main body or in a closed position where it is stored in a storage space (unillustrated) formed in the side surface of the main body to be a part of the side surface of the main body.

Figure 2:
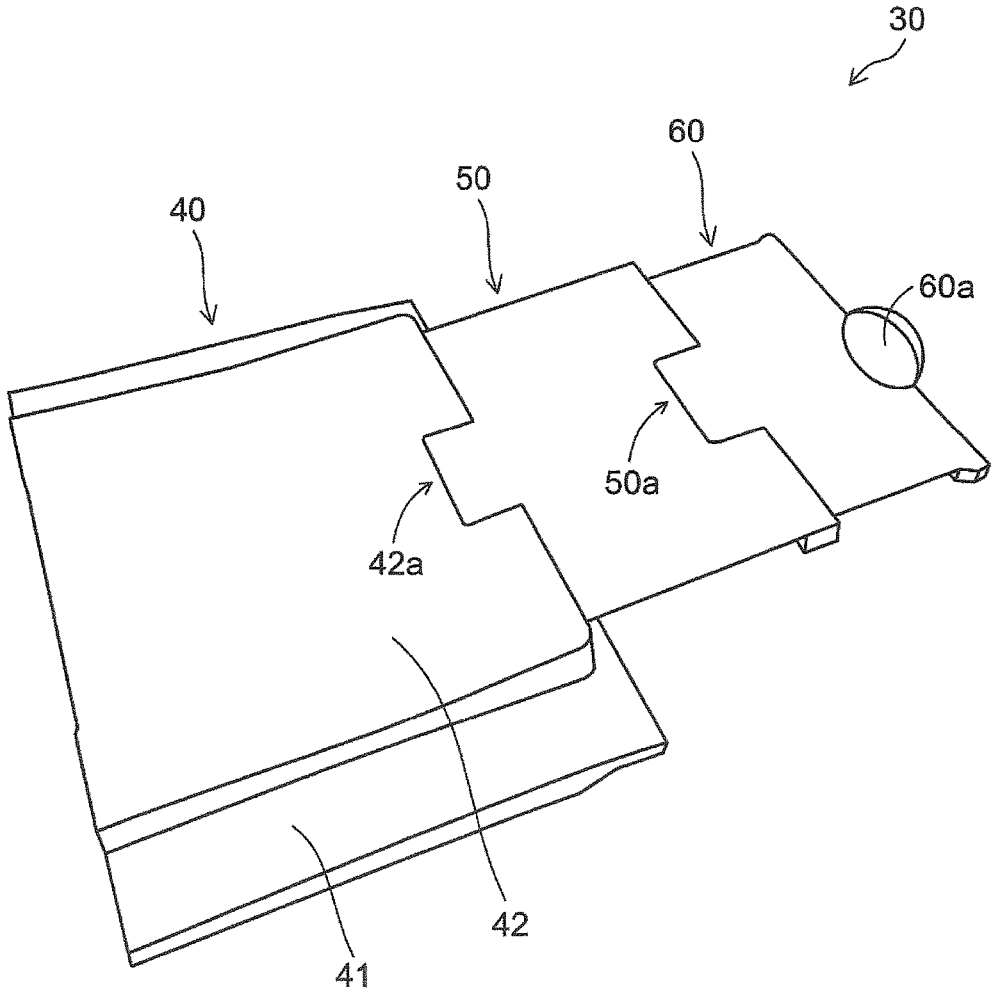
[FIG. 2] is a perspective view showing a structure of a second discharge tray according to the first embodiment of the present invention.

As shown in FIG. 2, the second discharge tray 30 is formed to be a pullout type such that its sheet placement surface is extendable. FIG. 2 shows a state as seen from the rear side in FIG. 1; the left and right in FIG. 2 are reversed as compared with those in FIG. 1.

The second discharge tray 30 includes a tray main body 40 fitted to the side surface of the main body of the image forming apparatus 100, a first slide member 50 which is slidable with respect to the tray main body 40, and a second slide member 60 which is slidable with respect to the first slide member 50. The tray main body 40, the first slide member 50, and the second slide member 60 are formed such that their lengths in the sheet width direction (the up/down direction in FIG. 2) are increasingly smaller in the order named.

The tray main body 40 includes a base portion 41, and a sheet placement portion 42 which protrudes upward from the base portion 41 and which has the sheet placement surface on which sheets are placed. As a result of the sheet placement portion 42 protruding upward from the base portion 41, a space is formed under the sheet placement portion 42. In the space, the first and second slide members 50 and 60 are stored in a state stacked on each other. Moreover, in the right end of a central part of the sheet placement portion 42 in the sheet width direction (the up/down direction in FIG. 2), a cutout portion 42*a* is formed so as to avoid contact with a holding portion 60*a*, which will be described later, of the second slide member 60 when the second slide member 60 is stored.

The first slide member 50 is arranged selectively either in a first stored position where it is stored in the tray main body 40 or in a first pulled-out position (the position in FIG. 2) where it is pulled out of the tray main body 40 so as to extend the sheet placement surface. Moreover, in the right end of a central part of the first slide member 50 in the sheet width direction (the up/down direction in FIG. 2), a cutout portion 50*a* is formed so as to avoid contact with the holding portion 60*a*, which will be described later, of the second slide member 60 when the second slide member 60 is stored.

The second slide member 60 is arranged selectively either in a second stored position where it is stored in the first slide member 50 or in a second pulled-out position (the position in FIG. 2) where it is pulled out of the first slide member 50 so as to extend the sheet placement surface. Moreover, at the right end of a central part of the second slide member 60 in the sheet width direction (the up/down direction in FIG. 2), the holding portion 60*a* is formed which is held by a user when the first and second slide members 50 and 60 are pulled out.

Figure 3:
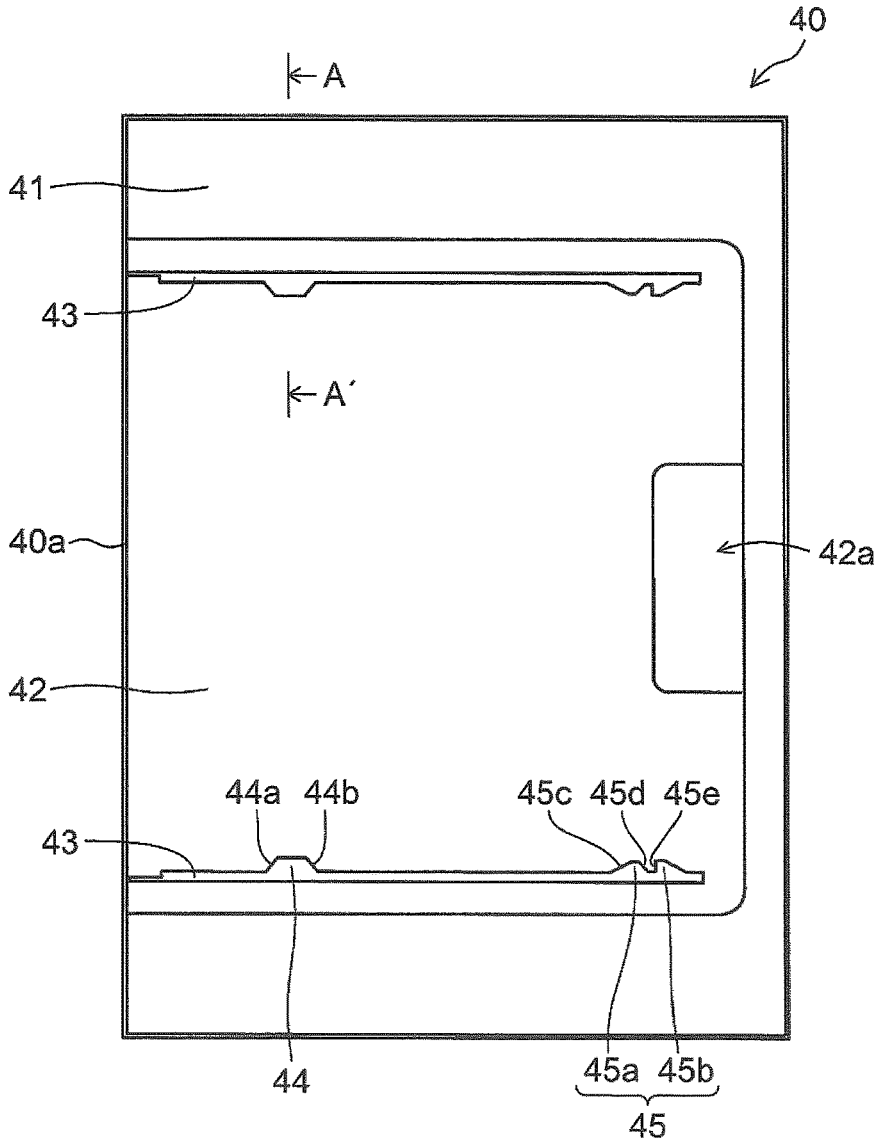
[FIG. 3] is a bottom view showing a structure of a tray main body of the second discharge tray shown in FIG. 2.
Figure 4:
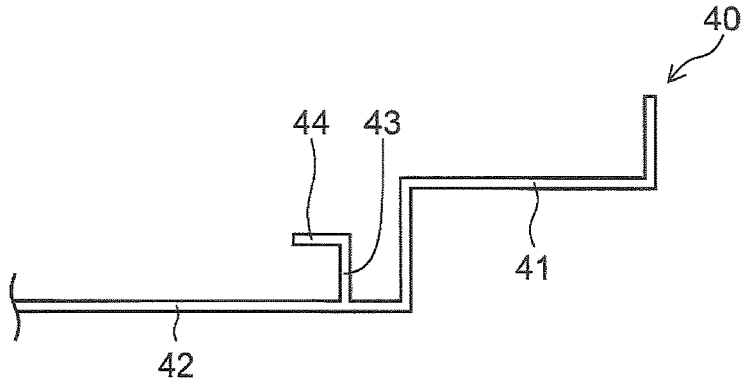
[FIG. 4] is a sectional view across line A-A' in FIG. 3.

On the reverse surface of the sheet placement portion 42 of the tray main body 40, as shown in FIGS. 3 and 4, there is provided, erect therefrom, a pair of guide rails 43 that guides the side surface of the first slide member 50. At a predetermined position on one side of the guide rails 43 (on the image forming apparatus 100-side, the left side), there is arranged a first storage engaged portion 44 which is engaged with a first engaging portion 52, which will be described later, of the first slide member 50 in a state (the state in FIG. 9) where the first slide member 50 is stored in the first stored position. Moreover, at a predetermined position on the other side of the guide rails 43 (on the opposite side from the image forming apparatus 100-side, the right side), there is arranged a first pullout engaged portion 45 which is engaged with the first engaging portion 52, which will be described later, of the first slide member 50 in a state (the state in FIGS. 10 and 11) where the first slide member 50 is pulled out in the first pulled-out position. The first storage engaged portion 44 and the first pullout engaged portion 45 are protruding portions that protrude from the bottom end of the guide rails 43 (the top end in FIG. 4) into the tray main body 40 (inward with respect to the sheet width direction).

The first storage engaged portion 44 has an engaging inclined surface 44*a* and a non-engaging inclined surface 44*b*. In a state (the state in FIG. 9) where the first slide member 50 is stored in the first stored position, the engaging inclined surface 44*a* is in contact (is engaged) with the first engaging portion 52, which will be described later, of the first slide member 50, but the non-engaging inclined surface 44*b* is not in contact (is not engaged) therewith.

The first pullout engaged portion 45 has an engaging protrusion 45*a* and a regulating protrusion 45*b*. In a state (the state in FIGS. 10 and 11) where the first slide member 50 is pulled out in the first pulled-out position, the engaging protrusion 45*a* is engaged with the first engaging portion 52, which will be described later, of the first slide member 50, and the regulating protrusion 45*b* regulates (restricts) the movement of the first slide member 50 in the pulling-out direction (the rightward direction). The engaging protrusion 45*a* has a non-engaging inclined surface 45*c* and an engaging inclined surface 45*d*. In a state where the first slide member 50 is pulled out in the first pulled-out position, the non-engaging inclined surface 45*c* is not in contact (is not engaged) with the first engaging portion 52, which will be described later, of the first slide member 50, but the engaging inclined surface 45*d* is in contact (is engaged) therewith. The regulating protrusion 45*b* has a regulating surface 45*e* which extends in a direction orthogonal to the pulling-out direction (in the sheet width direction) and which makes contact with the first engaging portion 52, which will be described later, of the first slide member 50 to regulate (restrict) its movement in the pulling-out direction (the rightward direction).

Figure 5:
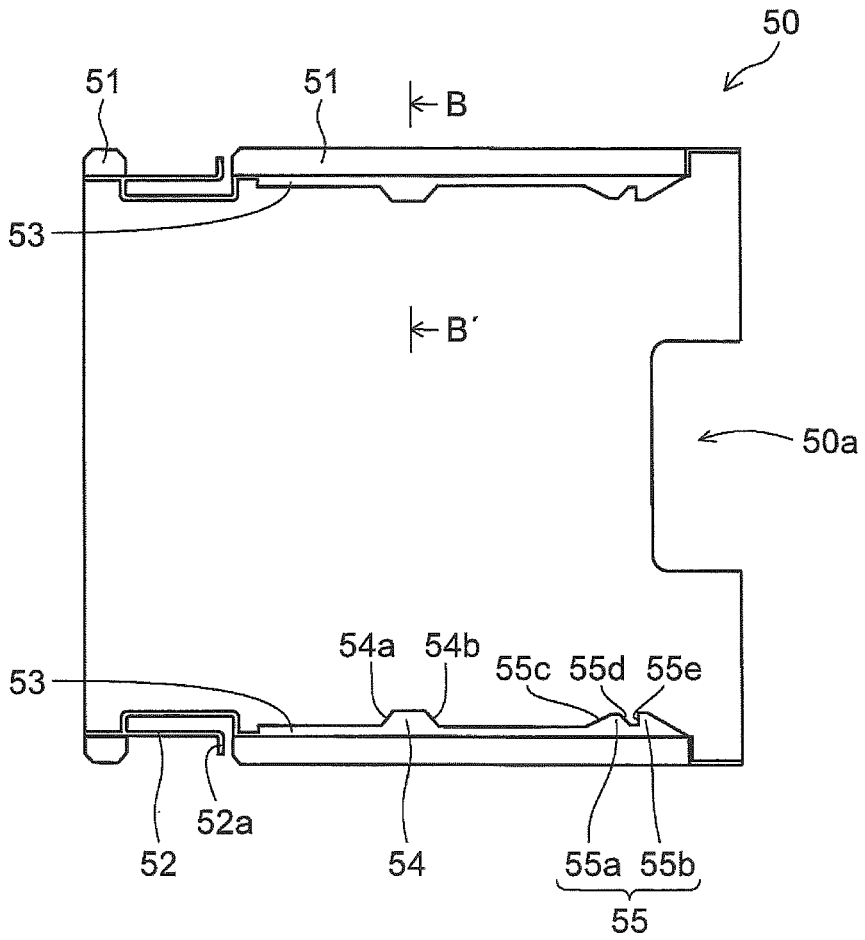
[FIG. 5] is a bottom view showing a structure of a first slide member of the second discharge tray shown in FIG. 2.
Figure 6:
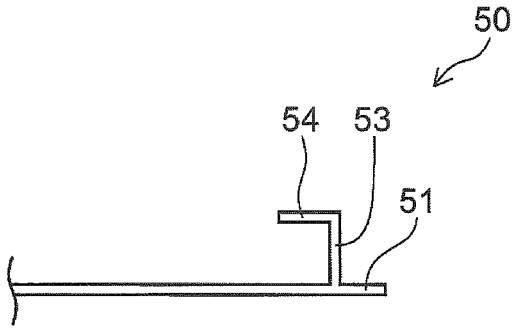
[FIG. 6] is a sectional view across line B-B' in FIG. 5.

In the side surface of the first slide member 50, as shown in FIGS. 5 and 6, there is formed a pair of guided portions 51 that slides along the pair of the guide rails 43 of the tray main body 40. Moreover, at a predetermined position on one side (the left side) of the side surface of the first slide member 50 is formed the first engaging portion 52 which is elastically deformable sideways (outward with respect to the sheet width direction) and which is engaged with the tray main body 40. The first engaging portion 52 is an elastic piece having a first engaging protrusion 52*a* which protrudes sideways and which is thereby engaged with the first storage engaged portion 44 and the first pullout engaged portion 45 of the tray main body 40.

Moreover, on the reverse surface of the first slide member 50, there is provided, erect therefrom, a pair of guide rails 53 that guides the side surface of the second slide member 60. At a predetermined position on one side (the left side) of the guide rails 53, there is arranged a second storage engaged portion 54 which is engaged with a second engaging portion 62, which will be described later, of the second slide member 60 in a state (the state in FIGS. 9 and 10) where the second slide member 60 is stored in the second stored position. Moreover, at a predetermined position on the other side (the right side) of the guide rails 53, there is arranged a second pullout engaged portion 55 which is engaged with the second engaging portion 62, which will be described later, of the second slide member 60 in a state (the state in FIG. 11) where the second slide member 60 is pulled out in the second pulled-out position. The second storage engaged portion 54 and the second pullout engaged portion 55 are protruding portions that protrude from the bottom end of the guide rails 53 (the top end in FIG. 6) into the first slide member 50 (inward with respect to the sheet width direction).

The second storage engaged portion 54 has an engaging inclined surface 54*a* and a non-engaging inclined surface 54*b*. In a state (the state in FIGS. 9 and 10) where the second slide member 60 is stored in the second stored position, the engaging inclined surface 54*a* is in contact (is engaged) with the second engaging portion 62, which will be described later, of the second slide member 60, but the non-engaging inclined surface 54*b* is not in contact (is not engaged) therewith.

The second pullout engaged portion 55 has an engaging protrusion 55*a* and a regulating protrusion 55*b*. In a state (the state in FIG. 11) where the second slide member 60 is pulled out in the second pulled-out position, the engaging protrusion 55*a* is engaged with the second engaging portion 62, which will be described later, of the second slide member 60, and the regulating protrusion 55*b* regulates (restricts) the movement of the second slide member 60 in the pulling-out direction (the rightward direction). The engaging protrusion 55*a* has a non-engaging inclined surface 55*c* and an engaging inclined surface 55*d*. In a state where the second slide member 60 is pulled out in the second pulled-out position, the non-engaging inclined surface 55*c* is not in contact (is not engaged) with the second engaging portion 62, which will be described later, of the second slide member 60, but the engaging inclined surface 55*d* is in contact (is engaged) therewith. The regulating protrusion 55*b* has a regulating surface 55*e* which extends in a direction orthogonal to the pulling-out direction (in the sheet width direction) and which makes contact with the second engaging portion 62, which will be described later, of the second slide member 60 to regulate (restrict) its movement in the pulling-out direction (the rightward direction).

Figure 7:
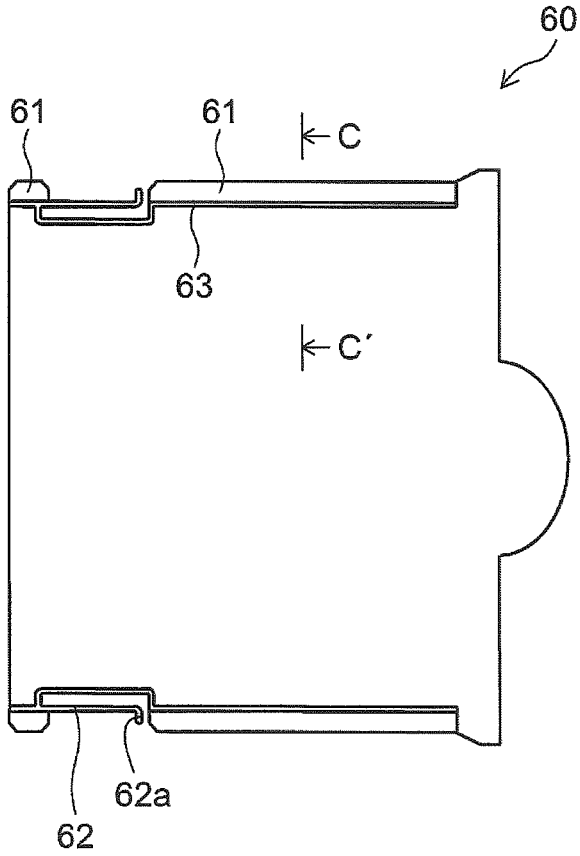
[FIG. 7] is a bottom view showing a structure of a second slide member of the second discharge tray shown in FIG. 2.
Figure 8:
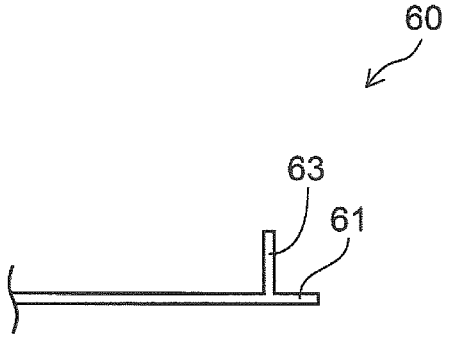
[FIG. 8] is a sectional view across line C-C' in FIG. 7.

In the side surface of the second slide member 60, as shown in FIGS. 7 and 8, there is formed a pair of guided portions 61 that slides along the pair of the guide rails 53 of the first slide member 50. Moreover, at a predetermined position on one side (the left side) of the side surface of the second slide member 60 is formed the second engaging portion 62 which is elastically deformable sideways (outward with respect to the sheet width direction) and which is engaged with the first slide member 50. The second engaging portion 62 is an elastic piece having a second engaging protrusion 62*a* which protrudes sideways and which is thereby engaged with the second storage engaged portion 54 and the second pullout engaged portion 55 of the first slide member 50. Moreover, on the reverse surface of the second slide member 60, a reinforcement rib 63 is provided erect therefrom along the guided portions 61.

Figure 12:
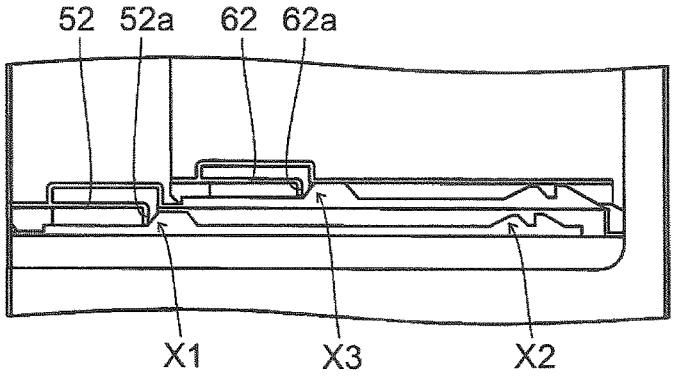
[FIG. 12] is a diagram showing how an engaging portion has different degrees of ease in sliding over each engaged portion when a slide member of the second discharge tray shown in FIG. 2 is pulled out.

In this embodiment, when, with the holding portion 60*a* held, the first and second slide members 50 and 60 are pulled out from a state (the state in FIG. 9) where they are stored respectively in the first and second stored positions, the engagement of the first storage engaged portion 44 of the tray main body 40 with the first engaging portion 52 of the first slide member 50 is released, and thereafter the engagement of the second storage engaged portion 54 of the first slide member 50 with the second engaging portion 62 of the second slide member 60 is released. That is, as shown in FIG. 12, the engaging portion (the first engaging portion 52, the second engaging portion 62) slides over X1 more easily than over X3. Although the strength of the engagement of the engaging portion (the first engaging portion 52, the second engaging portion 62) with the engaged portion (the first storage engaged portion 44, the second storage engaged portion 54) can be adjusted according to the elastic force (the resilient force) of the engaging portion, the protrusion amount of the engaged portion, the inclination angle of the engaging inclined surface of the engaged portion, etc., in this embodiment, the elastic force of the first engaging portion 52 is set substantially the same as the elastic force of the second engaging portion 62, while the protrusion amount of the second storage engaged portion 54 is set larger than the protrusion amount of the first storage engaged portion 44.

Figure 13:
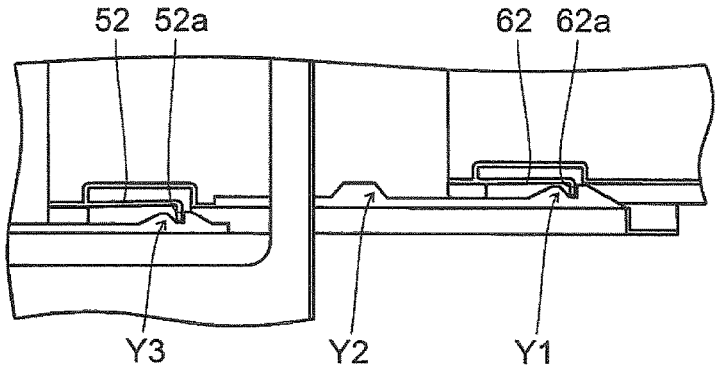
[FIG. 13] is a diagram showing how an engaging portion has different degrees of ease in sliding over each engaged portion when a slide member of the second discharge tray shown in FIG. 2 is stored.

On the other hand, when the first and second slide members 50 and 60 are stored from a state (the state in FIG. 11) where they are pulled out respectively in the first and second pulled-out positions, the engagement of the second pullout engaged portion 55 of the first slide member 50 with the second engaging portion 62 of the second slide member 60 is released, and thereafter the engagement of the first pullout engaged portion 45 of the tray main body 40 with the first engaging portion 52 of the first slide member 50 is released. That is, as shown in FIG. 13, the engaging portion (the second engaging portion 62, the first engaging portion 52) slides over Y1 more easily than over Y3. Although the strength of the engagement of the engaging portion (the second engaging portion 62, the first engaging portion 52) with the engaged portion (the second pullout engaged portion 55, the first pullout engaged portion 45) can be adjusted according to the elastic force (the resilient force) of the engaging portion, the protrusion amount of the engaged portion, the inclination angle of the engaging inclined surface of the engaged portion, etc., in this embodiment, the elastic force of the second engaging portion 62 is set substantially the same as the elastic force of the first engaging portion 52, while the protrusion amount of the first pullout engaged portion 45 is set larger than the protrusion amount of the second pullout engaged portion 55.

Furthermore, in this embodiment, when the first and second slide members 50 and 60 are pulled out, the first pullout engaged portion 45 of the tray main body 40 is engaged with the first engaging portion 52 of the first slide member 50, and thereafter the engagement of the second storage engaged portion 54 of the first slide member 50 with the second engaging portion 62 of the second slide member 60 is released. That is, as shown in FIG. 12, the engaging portion (the first engaging portion 52, the second engaging portion 62) slides over X2 more easily than over X3. The magnitude of a force required to engage the engaging portion (the first engaging portion 52) with the engaged portion (the first pullout engaged portion 45) can be adjusted according to the elastic force (the resilient force) of the engaging portion, the protrusion amount of the engaged portion, the inclination angle of the engaging inclined surface of the engaged portion, etc.

Moreover, when the first and second slide members 50 and 60 are stored, the second storage engaged portion 54 of the first slide member 50 is engaged with the second engaging portion 62 of the second slide member 60, and thereafter the engagement of the first pullout engaged portion 45 of the tray main body 40 with the first engaging portion 52 of the first slide member 50 is released. That is, as shown in FIG. 13, the engaging portion (the second engaging portion 62, the first engaging portion 52) slides over Y2 more easily than over Y3. The magnitude of a force required to engage the engaging portion (the second engaging portion 62) with the engaged portion (the second storage engaged portion 54) can be adjusted according to the elastic force (the resilient force) of the engaging portion, the protrusion amount of the engaged portion, the inclination angle of the engaging inclined surface of the engaged portion, etc.

Next, the pullout operation and storage operation of the first and second slide members 50 and 60 of the second discharge tray 30 will be described.

The first and second slide members 50 and 60 are pulled out from a state (the state in FIGS. 9 and 14) where they are stored in the first and second stored positions as follows. First, as shown in FIG. 15, the first engaging portion 52 of the first slide member 50 slides over the first storage engaged portion 44 of the tray main body 40, and thereby the engagement of the first engaging portion 52 of the first slide member 50 with the first storage engaged portion 44 of the tray main body 40 is released. This permits the first slide member 50 to slide in the rightward direction with respect to the tray main body 40 while the second slide member 60 remains stored in the second stored position.

Figure 10:
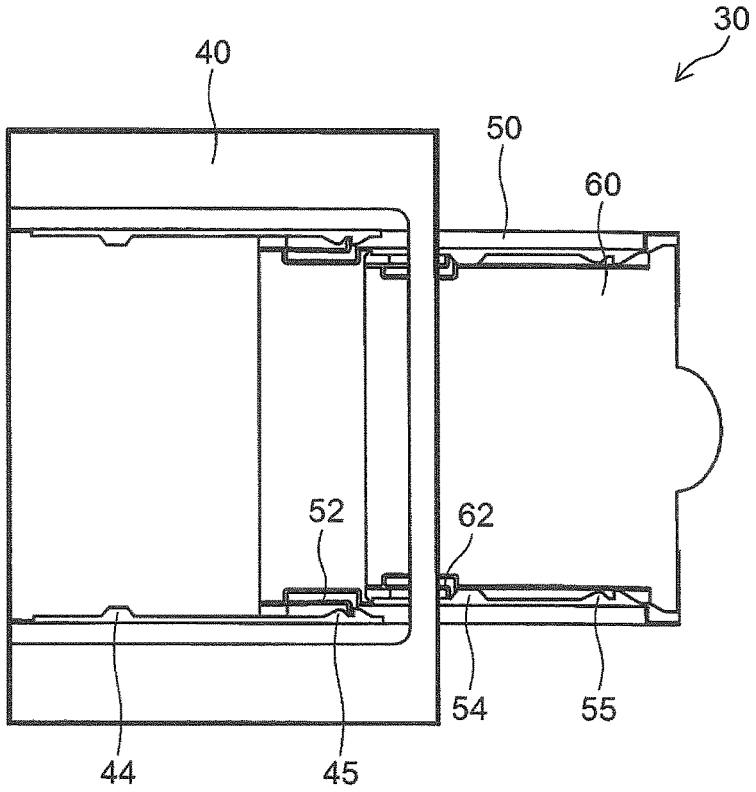
[FIG. 10] is a bottom view showing a state where a first slide member of the second discharge tray shown in FIG. 2 is pulled out while a second slide member remains stored in the first slide member.
Figure 16:
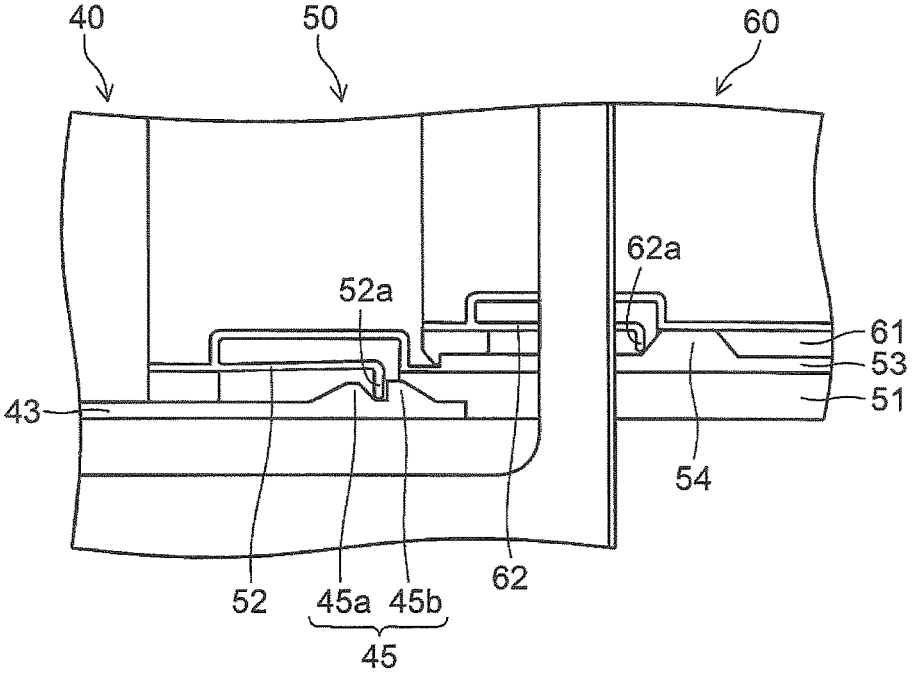
[FIG. 16] is a bottom view showing a structure of and around a first pullout engaged portion and a second storage engaged portion in the state shown in FIG. 10.

Then, the first engaging portion 52 of the first slide member 50 slides further over the engaging protrusion 45*a* of the first pullout engaged portion 45 of the tray main body 40 to be engaged with the first pullout engaged portion 45 of the tray main body 40, and thus the state shown in FIGS. 10 and 16 is achieved.

Thereafter, the second engaging portion 62 of the second slide member 60 slides over the second storage engaged portion 54 of the first slide member 50, and thereby the engagement of the second engaging portion 62 of the second slide member 60 with the second storage engaged portion 54 of the first slide member 50 is released. This permits the second slide member 60 to slide in the rightward direction with respect to the first slide member 50.

Figure 11:
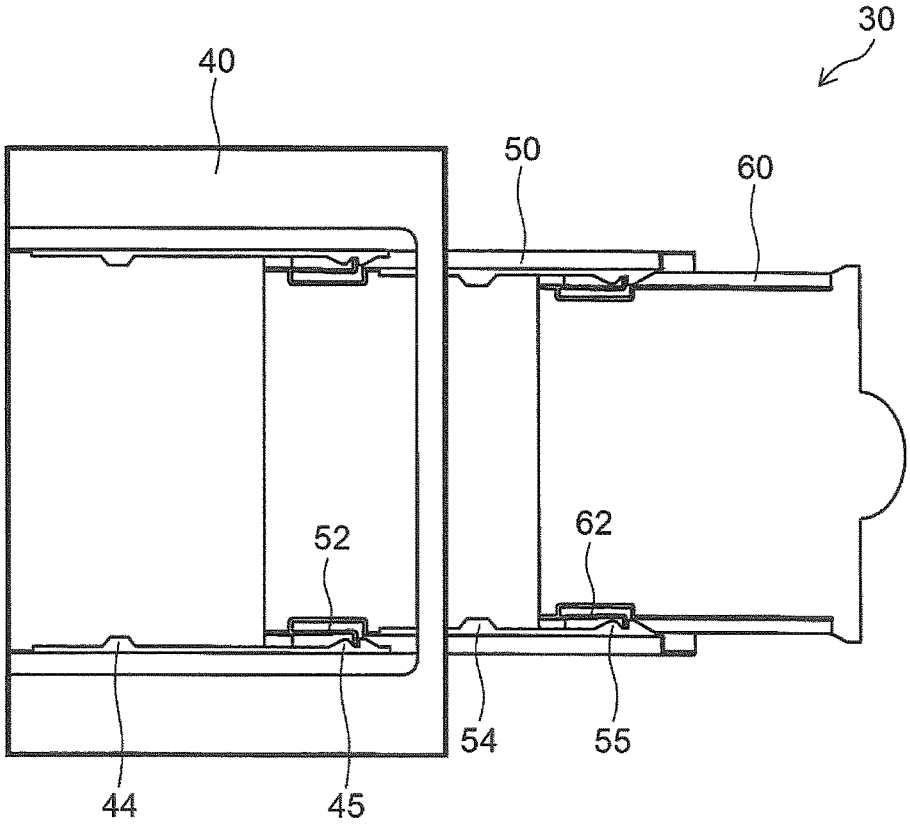
[FIG. 11] is a bottom view showing a state where first and second slide members of the second discharge tray shown in FIG. 2 are pulled out.
Figure 17:
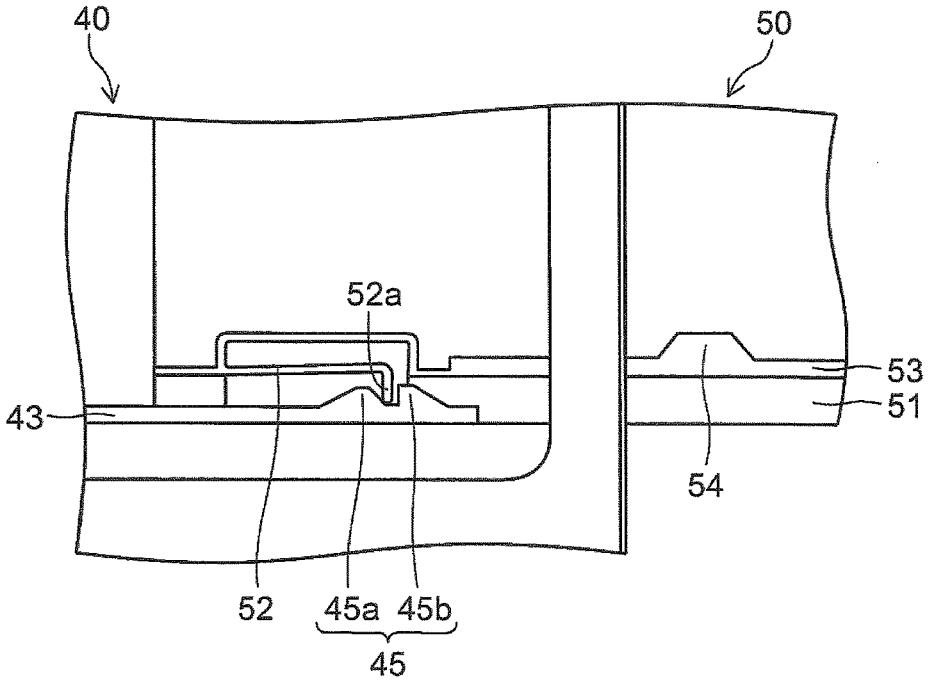
[FIG. 17] is a bottom view showing a structure of and around a first pullout engaged portion and a second storage engaged portion in the state shown in FIG. 11.
Figure 18:
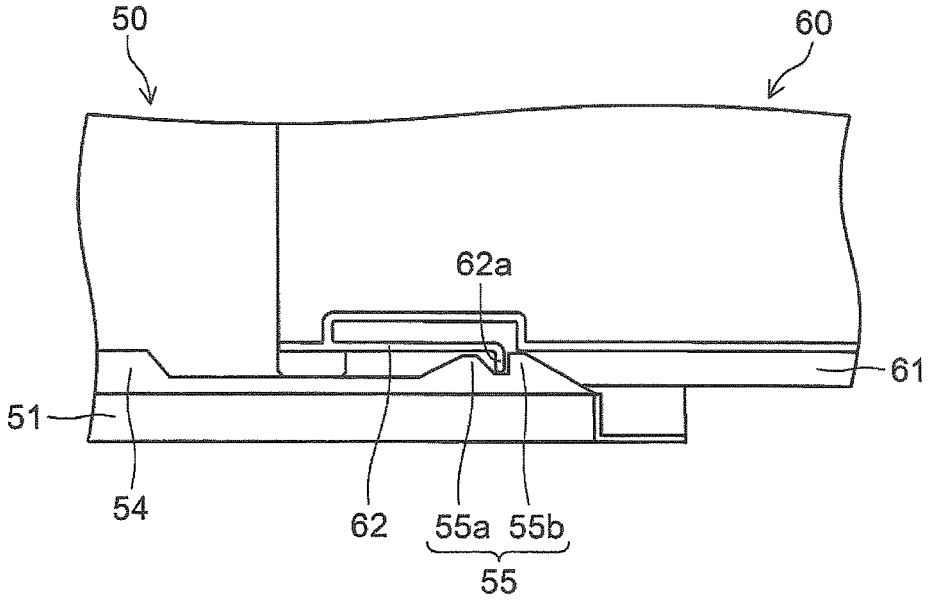
[FIG. 18] is a bottom view showing a structure of and around a second pullout engaged portion in the state shown in FIG. 11.

Then, the second engaging portion 62 of the second slide member 60 slides further over the engaging protrusion 55*a* of the second pullout engaged portion 55 of the first slide member 50 to be engaged with the second pullout engaged portion 55 of the first slide member 50, and thus the state shown in FIGS. 11, 17, and 18 is achieved. Now, the pulling-out of the first and second slide members 50 and 60 is complete.

Figure 19:
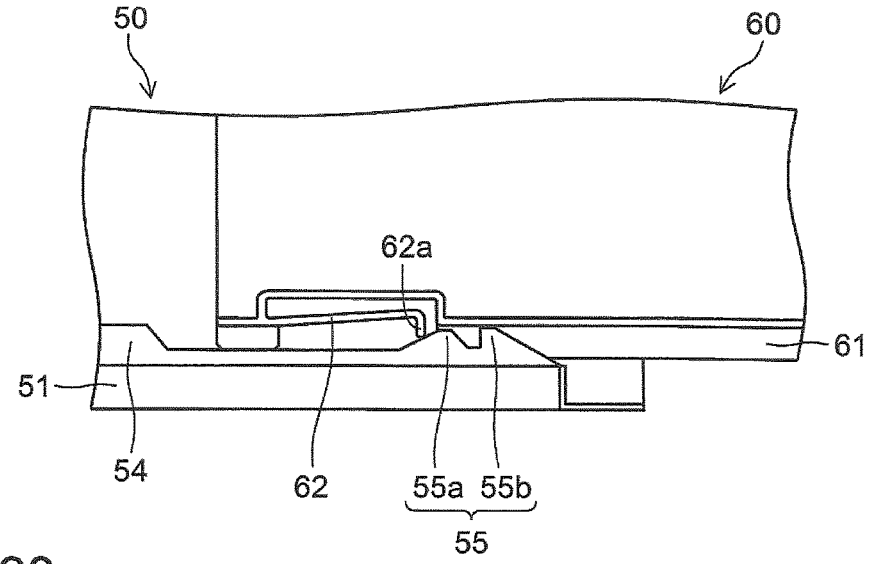
[FIG. 19] is a bottom view showing a state where a second engaging portion slides over a second pullout engaged portion from the state shown in FIG. 18.

On the other hand, the first and second slide members 50 and 60 are stored from a state (the state in FIGS. 11, 17, and 18) where they are pulled out in the first and second pulled-out positions as follows. First, as shown in FIG. 19, the second engaging portion 62 of the second slide member 60 slides over the engaging protrusion 55*a* of the second pullout engaged portion 55 of the first slide member 50, and thereby the engagement of the second engaging portion 62 of the second slide member 60 with the second pullout engaged portion 55 of the first slide member 50 is released. This permits the second slide member 60 to slide in the leftward direction with respect to the first slide member 50 while the first slide member 50 remains pulled out in the first pulled-out position.

Then, the second engaging portion 62 of the second slide member 60 slides further over the second storage engaged portion 54 of the first slide member 50 to be engaged therewith, and thus the state shown in FIGS. 10 and 16 is achieved. Here, as a result of the left-side end surface of the guided portions 61 making contact with the right-side end surface of the first engaging portion 52 of the first slide member 50, the movement of the second slide member 60 in the leftward direction is regulated (restricted).

Thereafter, the first engaging portion 52 of the first slide member 50 slides over the engaging protrusion 45*a* of the first pullout engaged portion 45 of the tray main body 40, and thereby the engagement of the first engaging portion 52 of the first slide member 50 with the first pullout engaged portion 45 of the tray main body 40 is released. This permits the first slide member 50 to slide in the leftward direction with respect to the tray main body 40 while the second slide member 60 remains stored in the second stored position.

Figure 9:
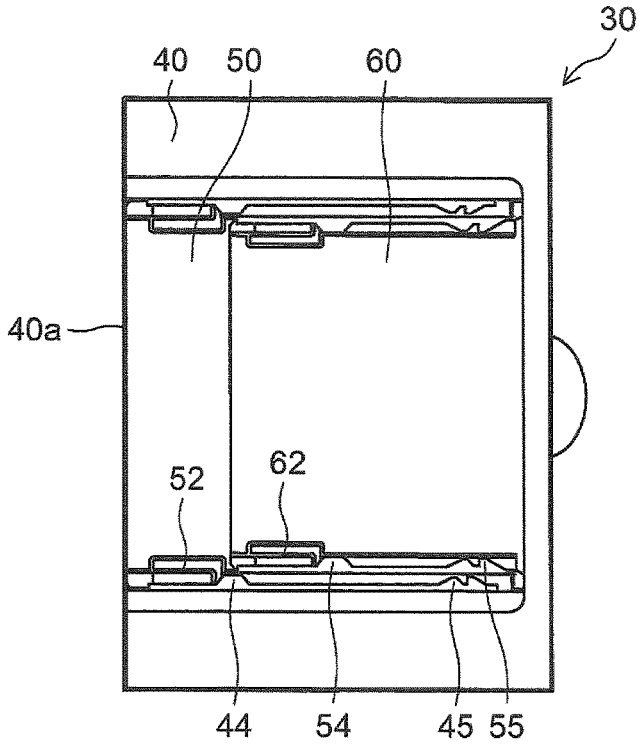
[FIG. 9] is a bottom view showing a state where first and second slide members of the second discharge tray shown in FIG. 2 are stored.
Figure 14:
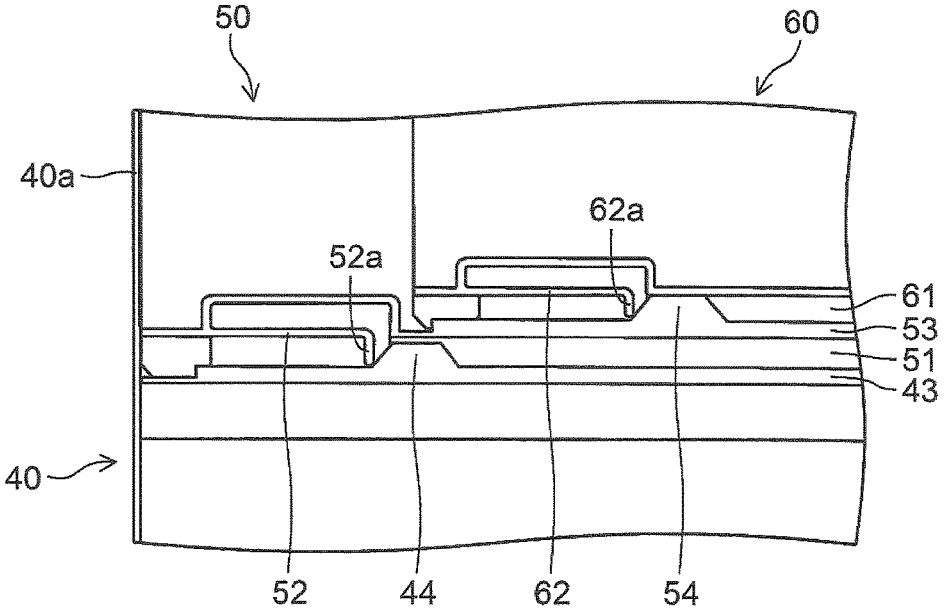
[FIG. 14] is a bottom view showing a structure of and around first and second storage engaged portions in the state shown in FIG. 9.
Figure 15:
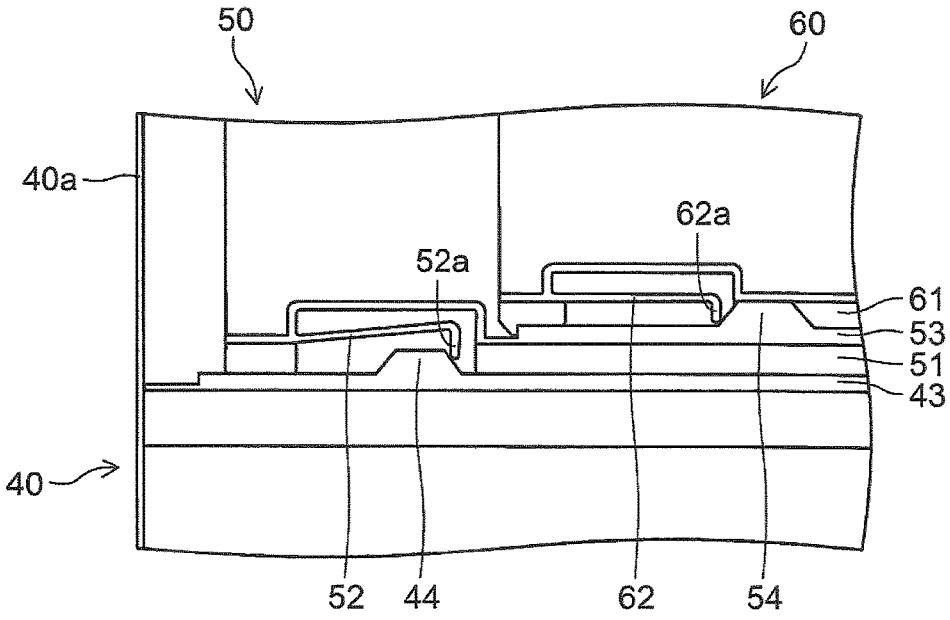
[FIG. 15] is a bottom view showing a state where a first engaging portion slides over a first storage engaged portion from the state shown in FIG. 14.

Then, the first engaging portion 52 of the first slide member 50 slides further over the first storage engaged portion 44 of the tray main body 40 to be engaged therewith, and thus the state shown in FIGS. 9 and 14 is achieved. Here, as a result of the left-side end surface of the first slide member 50 making contact with a wall portion 40*a* provided erect from the left-side end part of the tray main body 40, the movement of the first slide member 50 in the leftward direction is regulated (restricted). Now, the storing of the first and second slide members 50 and 60 is complete.

In this embodiment, as described above, when the first and second slide members 50 and 60 are pulled out from a state where they are stored respectively in the first and second stored positions, the engagement of the first storage engaged portion 44 of the tray main body 40 with the first engaging portion 52 of the first slide member 50 is released, and thereafter the engagement of the second storage engaged portion 54 of the first slide member 50 with the second engaging portion 62 of the second slide member 60 is released. In this way, when the first and second slide members 50 and 60 are pulled out, the first slide member 50 is pulled out first, and thus the second slide member 60, which is weak in strength due to its dimensions, can be prevented from being pulled out alone.

When the first and second slide members 50 and 60 are stored from a state where they are pulled out respectively in the first and second pulled-out positions, the engagement of the second pullout engaged portion 55 of the first slide member 50 with the second engaging portion 62 of the second slide member 60 is released, and thereafter the engagement of the first pullout engaged portion 45 of the tray main body 40 with the first engaging portion 52 of the first slide member 50 is released. In this way, when the first and second slide members 50 and 60 are stored, the second slide member 60 is stored first, and thus the second slide member 60, which is weak in strength due to its dimensions, can be prevented from being pulled out alone.

Thus, both when the first and second slide members 50 and 60 are pulled out and when they are stored, the second slide member 60, which is weak in strength due to its dimensions, can be prevented from being pulled out alone, and thereby the second discharge tray 30 can be prevented from being damaged by an external force.

Moreover, as described above, when the first and second slide members 50 and 60 are pulled out, the first pullout engaged portion 45 of the tray main body 40 is engaged with the first engaging portion 52 of the first slide member 50, and thereafter the engagement of the second storage engaged portion 54 of the first slide member 50 with the second engaging portion 62 of the second slide member 60 is released. In this way, until the first slide member 50 is pulled out completely with respect to the tray main body 40, the second slide member 60 can be prevented from starting to be pulled out with respect to the first slide member 50.

When the first and second slide members 50 and 60 are stored, the second storage engaged portion 54 of the first slide member 50 is engaged with the second engaging portion 62 of the second slide member 60, and thereafter the engagement of the first pullout engaged portion 45 of the tray main body 40 with the first engaging portion 52 of the first slide member 50 is released. In this way, until the second slide member 60 is stored completely with respect to the first slide member 50, the first slide member 50 can be prevented from starting to be stored with respect to the tray main body 40.

Thus, both when the first and second slide members 50 and 60 are pulled out and when they are stored, the second slide member 60, which is weak in strength due to its dimensions, can be prevented more effectively from being pulled out alone.

Moreover, as described above, on the side surface of the first slide member 50 is provided the first engaging portion 52 which is elastically deformable and which has the first engaging protrusion 52*a* that protrudes sideways, and on the side surface of the second slide member 60 is provided the second engaging portion 62 which is elastically deformable and which has the second engaging protrusion 62*a* that protrudes sideways. Thus, it is possible to easily engage and disengage the tray main body 40 and the first slide member 50 with and from each other, and it is also possible to easily engage and disengage the first slide member 50 and the second slide member 60 with and from each other.

Moreover, as described above, the protrusion amount of the second storage engaged portion 54 is larger than that of the first storage engaged portion 44. Thus, when the first and second slide members 50 and 60 are pulled out, it is possible to easily release the engagement of the first storage engaged portion 44 of the tray main body 40 with the first engaging portion 52 of the first slide member 50 and thereafter the engagement of the second storage engaged portion 54 of the first slide member 50 with the second engaging portion 62 of the second slide member 60. Moreover, the protrusion amount of the first pullout engaged portion 45 is larger than that of the second pullout engaged portion 55. Thus, when the first and second slide members 50 and 60 are stored, it is possible to easily release the engagement of the second pullout engaged portion 55 of the first slide member 50 with the second engaging portion 62 of the second slide member 60 and thereafter the engagement of the first pullout engaged portion 45 of the tray main body 40 with the first engaging portion 52 of the first slide member 50.

Second Embodiment

As a second embodiment, a description will be given of how an order is introduced in the strength of the engagement of the engaging portions (the first engaging portion 52, the second engaging portion 62) with the engaged portions (the first storage engaged portion 44, the first pullout engaged portion 45, the second storage engaged portion 54, the second pullout engaged portion 55) by varying the inclination angle of the inclined surfaces of the engaged portions.

Figure 20:
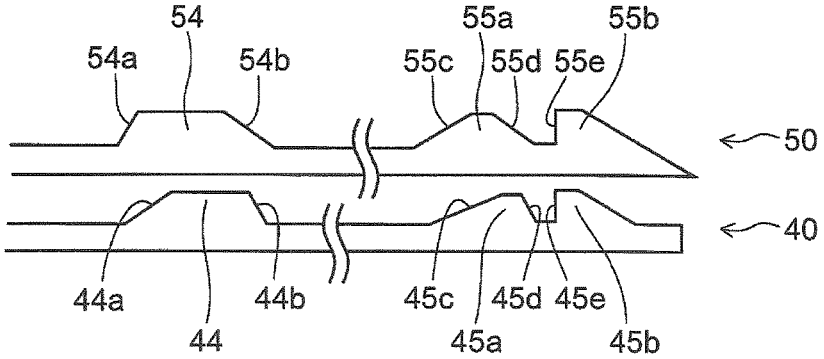
[FIG. 20] is a diagram illustrating inclination angles of inclined surfaces of engaged portions of a second discharge tray according to a second embodiment of the present invention.

As shown in FIG. 20, the inclination angle (the inclination angle with respect to the retracting/extracting direction (the leftward/rightward direction)) of the engaging inclined surface (a second engaging inclined surface) 54*a* of the second storage engaged portion 54 is made larger than the inclination angle of the engaging inclined surface (a first engaging inclined surface) 44*a* of the first storage engaged portion 44 and the inclination angle of the non-engaging inclined surface 45*c* of the first pullout engaged portion 45. Moreover, the inclination angle of the engaging inclined surface (a third engaging inclined surface) 45*d* of the first pullout engaged portion 45 is made larger than the inclination angle of the engaging inclined surface (a fourth engaging inclined surface) 55*d* of the second pullout engaged portion 55 and the inclination angle of the non-engaging inclined surface 54*b* of the second storage engaged portion 54.

In this embodiment, the elastic force of the first engaging portion 52 is set substantially the same as the elastic force of the second engaging portion 62, and the protrusion amount of the second storage engaged portion 54 is set substantially the same as the protrusion amount of the first storage engaged portion 44 and the protrusion amount of the engaging protrusion 45*a*.

Otherwise, the structure in the second embodiment is similar to that in the previously-described first embodiment.

Figure 21:
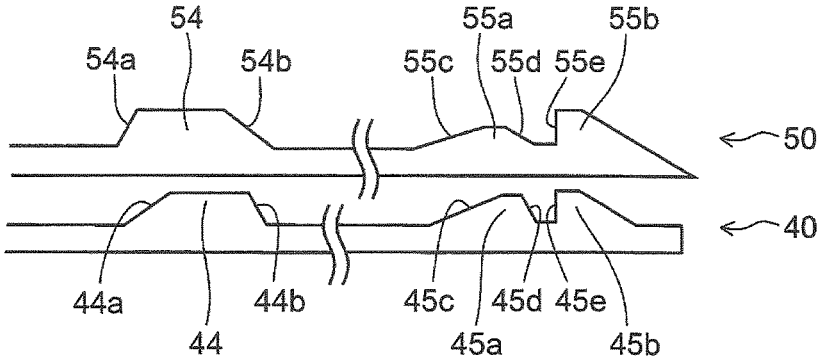
[FIG. 21] is a diagram showing a structure of an engaged portion of a second discharge tray according to a modified example of the second embodiment of the present invention.

The engaging protrusion 55*a* of the second pullout engaged portion 55 has only to be engaged with the second engaging portion 62, and thus, as in the modified example of the second embodiment shown in FIG. 21, the protrusion amount of the engaging protrusion 55*a* can be reduced. The same applies to other embodiments.

In this embodiment, as described above, the inclination angle of the engaging inclined surface 54*a* of the second storage engaged portion 54 is made larger than the inclination angle of the engaging inclined surface 44*a* of the first storage engaged portion 44. Thus, when the first and second slide members 50 and 60 are pulled out from a state where they are stored respectively in the first and second stored positions, it is possible to easily release the engagement of the first storage engaged portion 44 of the tray main body 40 with the first engaging portion 52 of the first slide member 50 and thereafter the engagement of the second storage engaged portion 54 of the first slide member 50 with the second engaging portion 62 of the second slide member 60.

Moreover, the inclination angle of the engaging inclined surface 45*d* of the first pullout engaged portion 45 is made larger than the inclination angle of the engaging inclined surface 55*d* of the second pullout engaged portion 55. Thus, when the first and second slide members 50 and 60 are stored from a state where they are pulled out respectively in the first and second pulled-out positions, it is possible to easily release the engagement of the second pullout engaged portion 55 of the first slide member 50 with the second engaging portion 62 of the second slide member 60 and thereafter the engagement of the first pullout engaged portion 45 of the tray main body 40 with the first engaging portion 52 of the first slide member 50.

Moreover, as described above, the inclination angle of the engaging inclined surface 54*a* of the second storage engaged portion 54 is made larger than the inclination angle of the non-engaging inclined surface 45*c* of the first pullout engaged portion 45. Thus, when the first and second slide members 50 and 60 are pulled out, it is possible to easily engage the first pullout engaged portion 45 of the tray main body 40 with the first engaging portion 52 of the first slide member 50 and thereafter release the engagement of the second storage engaged portion 54 of the first slide member 50 with the second engaging portion 62 of the second slide member 60.

Moreover, the inclination angle of the engaging inclined surface 45*d* of the first pullout engaged portion 45 is made larger than the inclination angle of the non-engaging inclined surface 54*b* of the second storage engaged portion 54. Thus, when the first and second slide members 50 and 60 are stored, it is possible to easily engage the second storage engaged portion 54 of the first slide member 50 with the second engaging portion 62 of the second slide member 60 and thereafter release the engagement of the first pullout engaged portion 45 of the tray main body 40 with the first engaging portion 52 of the first slide member 50.

As described above, in the second embodiment, as in the first embodiment, both when the first and second slide members 50 and 60 are pulled out and when they are stored, the second slide member 60, which is weak in strength due to its dimensions, can be prevented from being pulled out alone, and thereby the second discharge tray 30 can be prevented from being damaged by an external force.

Otherwise, the effects of the second embodiment are similar to those of the previously-described first embodiment.

Third Embodiment

As a third embodiment, a description will be given of how an order is introduced in the strength of the engagement of the engaging portions (the first engaging portion 52, the second engaging portion 62) with the engaged portions (the first storage engaged portion 44, the first pullout engaged portion 45, the second storage engaged portion 54, the second pullout engaged portion 55) by varying the friction force of the engaging portions with respect to the engaged portions.

The tray main body 40, the first slide member 50, and the second slide member 60 are made of polycarbonate, polyethylene, or the like, and are all formed of the same resin.

Figure 22:
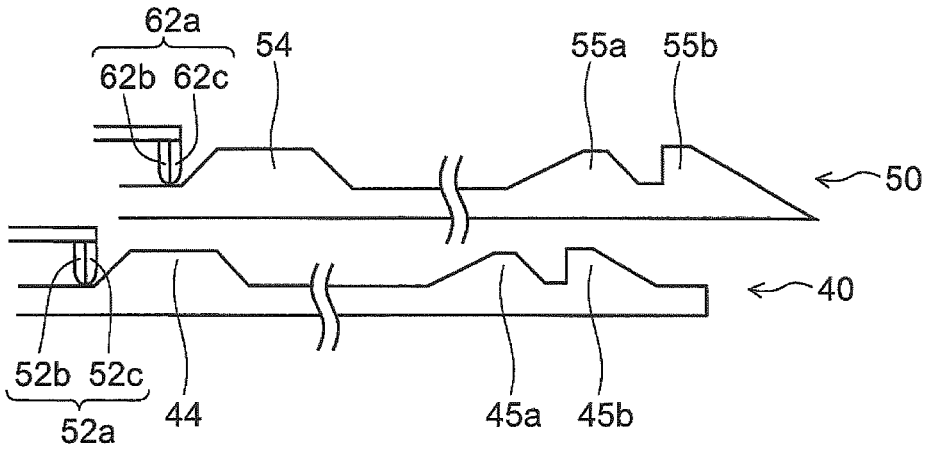
[FIG. 22] is a diagram illustrating a structure of first and second engaging protrusions of a second discharge tray according to a third embodiment of the present invention.
Figure 23:
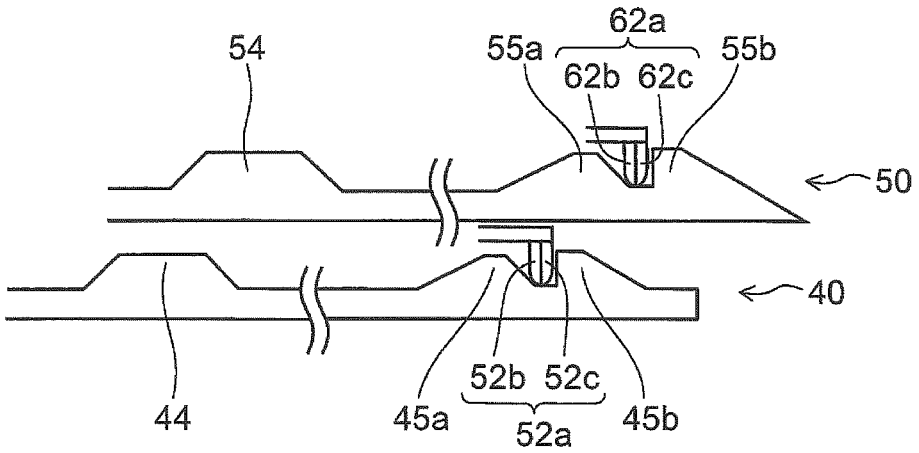
[FIG. 23] is a diagram illustrating a structure of first and second engaging protrusions of a second discharge tray according to the third embodiment of the present invention.

As shown in FIGS. 22 and 23, a storing direction-side (left-side) part (a part that makes contact with the engaging inclined surface 45*d* of the engaging protrusion 45*a* of the first pullout engaged portion 45) of the first engaging protrusion 52*a* of the first engaging portion 52 is made of rubber or the like, and forms a high friction portion 52*b* having a comparatively high friction coefficient with respect to the tray main body 40. Moreover, a pulling-out direction-side (right-side) part (a part that makes contact with the engaging inclined surface 44*a* of the first storage engaged portion 44) of the first engaging protrusion 52*a* is made of resin such as polycarbonate, polyethylene, or the like, and forms a low friction portion 52*c* having a lower friction coefficient than the high friction portion 52*b* with respect to the tray main body 40.

On the other hand, a storing direction-side (left-side) part (a part that makes contact with the engaging inclined surface 55*d* of the engaging protrusion 55*a* of the second pullout engaged portion 55) of the second engaging protrusion 62*a* of the second engaging portion 62 is made of resin such as polycarbonate, polyethylene, or the like, and forms a low friction portion 62*b* having a comparatively low friction coefficient with respect to the first slide member 50. Moreover, a pulling-out direction-side (right-side) part (a part that makes contact with the engaging inclined surface 54*a* of the second storage engaged portion 54) of the second engaging protrusion 62*a* is made of the same material as the high friction portion 52*b*, such as rubber, and forms a high friction portion 62*c* having a higher friction coefficient than the low friction portion 62*b* with respect to the first slide member 50.

In this embodiment, the elastic force of the first engaging portion 52 is set substantially the same as the elastic force of the second engaging portion 62, and the protrusion amount of the second storage engaged portion 54 is set substantially the same as the protrusion amount of the first storage engaged portion 44 and the protrusion amount of the engaging protrusion 45*a*. Moreover, the inclination angle of the engaging inclined surface of the first storage engaged portion 44 is set substantially the same as that of the second storage engaged portion 54, and the inclination angle of the engaging inclined surface of the first pullout engaged portion 45 is set substantially the same as that of the second pullout engaged portion 55.

Otherwise, the structure in the second embodiment is similar to that in the previously-described first embodiment.

In this embodiment, as described above, the low friction portion 52*c* is provided in a pulling-out direction-side (right-side) part of the first engaging protrusion 52*a*, and the high friction portion 62*c* is provided in a pulling-out direction-side (right-side) part of the second engaging protrusion 62*a*. Thus, when the first and second slide members 50 and 60 are pulled out from a state where they are stored respectively in the first and second stored positions, it is possible to easily release the engagement of the first storage engaged portion 44 of the tray main body 40 with the first engaging portion 52 of the first slide member 50 and thereafter the engagement of the second storage engaged portion 54 of the first slide member 50 with the second engaging portion 62 of the second slide member 60. It is also possible to easily engage the first pullout engaged portion 45 of the tray main body 40 with the first engaging portion 52 of the first slide member 50 and thereafter release the engagement of the second storage engaged portion 54 of the first slide member 50 with the second engaging portion 62 of the second slide member 60.

Moreover, the high friction portion 52*b* is provided in a storing direction-side (left-side) part of the first engaging protrusion 52*a*, and the low friction portion 62*b* is provided in a storing direction-side (left-side) part of the second engaging protrusion 62*a*. Thus, when the first and second slide members 50 and 60 are stored from a state where they are pulled out respectively in the first and second pulled-out positions, it is possible to easily release the engagement of the second pullout engaged portion 55 of the first slide member 50 with the second engaging portion 62 of the second slide member 60 and thereafter the engagement of the first pullout engaged portion 45 of the tray main body 40 with the first engaging portion 52 of the first slide member 50. It is also possible to easily engage the second storage engaged portion 54 of the first slide member 50 with the second engaging portion 62 of the second slide member 60 and thereafter release the engagement of the first pullout engaged portion 45 of the tray main body 40 with the first engaging portion 52 of the first slide member 50.

As described above, also in the third embodiment, as in the previously-described first and second embodiments, both when the first and second slide members 50 and 60 are pulled out and when they are stored, the second slide member 60, which is weak in strength due to its dimensions, can be prevented from being pulled out alone, and thereby the second discharge tray 30 can be prevented from being damaged by an external force.

Otherwise, the effects of the third embodiment are similar to those of the previously-described first embodiment.

It should be understood that the embodiments disclosed herein are in every aspect illustrative and not restrictive. The scope of the present invention is defined not by the description of embodiments given above but by the appended claims, and encompasses many modifications and variations made in the sense and scope equivalent to those of the claims.

For example, although the above-described embodiments deal with, as an example, an image forming apparatus exploiting electrophotography, this is in no way meant to limit the present invention. The present invention is applicable equally to image forming apparatuses adopting other image forming methods such as an inkjet method, a thermal transfer method, etc. The present invention is widely applicable also to devices which simply transport sheets, devices which post-process sheets having undergone image formation or the like, etc.

Moreover, although the above-described embodiments deal with a case where the sheet placement tray is a discharge tray, this is in no way meant to limit the present invention. Instead, the sheet placement tray may be a sheet feed tray.

Moreover, although the above-described embodiments deal with an example where the first and second engaging portions are formed in the side surfaces of the first and second slide members, this is in no way meant to limit the present invention. Instead, the first and second engaging portions may be formed in central parts of the first and second slide members in the sheet width direction. In this case, for example, the first engaging portion which is elastically deformable in the up/down direction may be formed in a central part of the first slide member in the sheet width direction, and the first storage engaged portion and the first pullout engaged portion may be formed in a central part of the reverse surface of the tray main body in the sheet width direction. Likewise, the second engaging portion which is elastically deformable in the up/down direction may be formed in a central part of the second slide member in the sheet width direction, and the second storage engaged portion and the second pullout engaged portion may be formed in a central part of the reverse surface of the first slide member in the sheet width direction. Moreover, the first and second engaging portions may be formed in both the side surfaces and the central parts of the first and second slide members in the sheet width direction.

Moreover, the technical scope of the present invention encompasses any structure obtained by combining, as necessary, the structures of the above-described embodiments and modified examples.

The invention claimed is:

1. A sheet placement tray comprising:

a tray main body which has a sheet placement surface on which sheets are placed;

a first slide member which is slidable with respect to the tray main body and which is arranged selectively either in a first stored position where the first slide member is stored in the tray main body or in a first pulled-out position where the first slide member is pulled out of the tray main body so as to extend the sheet placement surface; and a second slide member which is slidable with respect to the first slide member and which is arranged selectively either in a second stored position where the second slide member is stored in the first slide member or in a second pulled-out position where the second slide member is pulled out of the first slide member so as to extend the sheet placement surface, wherein the tray main body includes:

a first storage engaged portion which is engaged with a first engaging portion of the first slide member in a state where the first slide member is stored in the first stored position; and a first pullout engaged portion which is engaged with the first engaging portion in a state where the first slide member is pulled out in the first pulled-out position, the first slide member includes:

the first engaging portion;

a second storage engaged portion which is engaged with a second engaging portion of the second slide member in a state where the second slide member is stored in the second stored position; and a second pullout engaged portion which is engaged with the second engaging portion in a state where the second slide member is pulled out in the second pulled-out position, the second slide member includes the second engaging portion, the first engaging portion is provided on a side surface of the first slide member and is an elastically deformable elastic piece having a first engaging protrusion which protrudes sideways, the first storage engaged portion and the first pullout engaged portion are protruding portions which protrude into the tray main body and which are engaged with the first engaging protrusion, the second engaging portion is provided on a side surface of the second slide member and is an elastically deformable elastic piece having a second engaging protrusion which protrudes sideways, the second storage engaged portion and the second pullout engaged portion are protruding portions which protrude into the first slide member and which are engaged with the second engaging protrusion, when the first and second slide members are pulled out from a state where the first and second slide members are stored respectively in the first and second stored positions, engagement of the first storage engaged portion with the first engaging portion is released, and thereafter engagement of the second storage engaged portion with the second engaging portion is released, when the first and second slide members are stored from a state where the first and second slide members are pulled out respectively in the first and second pulled-out positions, engagement of the second pullout engaged portion with the second engaging portion is released, and thereafter engagement of the first pullout engaged portion with the first engaging portion is released, the second storage engaged portion has a lamer protrusion amount than the first storage engaged portion, and the first pullout engaged portion has a larger protrusion amount than the second pullout engaged portion.

2. The sheet placement tray of claim 1, wherein, when the first and second slide members are pulled out respectively from the first and second stored positions, the first pullout engaged portion is engaged with the first engaging portion, and thereafter the engagement of the second storage engaged portion with the second engaging portion is released, and when the first and second slide members are stored respectively from the first and second pulled-out positions, the second storage engaged portion is engaged with the second engaging portion, and thereafter the engagement of the first pullout engaged portion with the first engaging portion is released.

3. An image forming apparatus comprising the sheet placement tray of claim 1.

4. A sheet placement tray comprising:

a tray main body which has a sheet placement surface on which sheets are placed;

a first slide member which is slidable with respect to the tray main body and which is arranged selectively either in a first stored position where the first slide member is stored in the tray main body or in a first pulled-out position where the first slide member is pulled out of the tray main body so as to extend the sheet placement surface; and a second slide member which is slidable with respect to the first slide member and which is arranged selectively either in a second stored position where the second slide member is stored in the first slide member or in a second pulled-out position where the second slide member is pulled out of the first slide member so as to extend the sheet placement surface, wherein the tray main body includes:

a first storage engaged portion which is engaged with a first engaging portion of the first slide member in a state where the first slide member is stored in the first stored position; and a first pullout engaged portion which is engaged with the first engaging portion in a state where the first slide member is pulled out in the first pulled-out position, the first slide member includes:

the first engaging portion;

a second storage engaged portion which is engaged with a second engaging portion of the second slide member in a state where the second slide member is stored in the second stored position; and a second pullout engaged portion which is engaged with the second engaging portion in a state where the second slide member is pulled out in the second pulled-out position, the second slide member includes the second engaging portion, the first storage engaged portion has a first engaging inclined surface which is engaged with the first engaging portion in a state where the first slide member is stored in the first stored position, the second storage engaged portion has a second engaging inclined surface which is engaged with the second engaging portion in a state where the second slide member is stored in the second stored position, an inclination angle of the second engaging inclined surface is larger than an inclination angle of the first engaging inclined surface, the first pullout engaged portion has a third engaging inclined surface which is engaged with the first engaging portion in a state where the first slide member is pulled out in the first pulled-out position, the second pullout engaged portion has a fourth engaging inclined surface which is engaged with the second engaging portion in a state where the second slide member is pulled out in the second pulled-out position, an inclination angle of the third engaging inclined surface is larger than an inclination angle of the fourth engaging inclined surface, when the first and second slide members are pulled out from a state where the first and second slide members are stored respectively in the first and second stored positions, engagement of the first storage engaged portion with the first engaging portion is released, and thereafter engagement of the second storage engaged portion with the second engaging portion is released, and when the first and second slide members are stored from a state where the first and second slide members are pulled out respectively in the first and second pulled-out positions, engagement of the second pullout engaged portion with the second engaging portion is released, and thereafter engagement of the first pullout engaged portion with the first engaging portion is released.

5. The sheet placement tray of claim 4, wherein, when the first and second slide members are pulled out respectively from the first and second stored positions, the first pullout engaged portion is engaged with the first engaging portion, and thereafter the engagement of the second storage engaged portion with the second engaging portion is released, and when the first and second slide members are stored respectively from the first and second pulled-out positions, the second storage engaged portion is engaged with the second engaging portion, and thereafter the engagement of the first pullout engaged portion with the first engaging portion is released.

6. An image forming apparatus comprising the sheet placement tray of claim 4.

* * * * *